United States Patent [19]

Carlton

[11] 4,308,798

[45] Jan. 5, 1982

[54] NEWSPRINT PRESS ORIENTATION DEVICE

[76] Inventor: Bruce E. Carlton, 234 Edgewood Ave., Mill Valley, Calif. 94941

[21] Appl. No.: 172,402

[22] Filed: Jul. 25, 1980

[51] Int. Cl.[3] ..... B41M 1/00

[52] U.S. Cl. ..... 101/426; 83/71; 33/494; 226/2

[58] Field of Search ..... 101/426, 224, 226–228; 226/92, 2, 9; 83/13, 33, 71, 927; 270/21.1; 33/494

[56] References Cited

U.S. PATENT DOCUMENTS

| | | | |
|---|---|---|---|
| 3,697,300 | 10/1972 | Von Hofe | 101/227 X |
| 3,827,355 | 8/1974 | Hamisch, Sr. | 101/226 X |
| 3,955,502 | 5/1976 | Von Hofe | 101/226 |
| 4,081,944 | 4/1978 | Sjostrand | 226/2 |
| 4,111,121 | 9/1978 | Borum | 101/228 X |

*Primary Examiner*—E. H. Eickholt

*Attorney, Agent, or Firm*—Melvin R. Stidham

[57] ABSTRACT

A device for orienting a newsprint web to be fed through a press comprising a roll of adhesive tape with pairs of adjacent marks spaced along the length thereof. The space between the marks of each pair is equal to the distance between the top or head of one printed page and the bottom or tail of the next succeeding printed page, and the space between pairs of marks is equal to the length of a page of print. A length of tape is threaded through to the former and a pair of marks are aligned with marks which represent the proper positioning for the margins they represent. Additional tape is threaded through the printing unit and orientation marks on the trailing segment of the first length are aligned with the blanket opening on the second impression cylinder and adhered to the tape at the printing unit. The trailing end of that length of tape is then dropped to be adhered to the leading end of a new roll of newsprint.

5 Claims, 2 Drawing Figures

NEWSPRINT PRESS ORIENTATION DEVICE

BACKGROUND OF THE INVENTION

According to present practice, a roll of newsprint is simply fed to the printing press to be severed at the cutting cylinder. Then, it is usually necessary to jockey and manipulate the sheet back and forth between pipe rollers, or to adjust compensating roller so that the web will be severed precisely between adjacent margins. With the newsprint webs more than two feet wide, the lengthy sheet is difficult to maneuver, and starting a new run may require several hands to handle the web in order to insure proper alignment without tearing. With mounting labor costs this may become a serious cost problem.

OBJECTS OF THE INVENTION

It is an object of this invention to provide an easily handled means for properly orienting a web of newsprint to be run through a printing press.

It is further object of this invention to provide a means for orienting a web of newsprint, without requiring handling of the printed web.

Other objects and advantages of this invention will become apparent from the description to follow, particularly when read in conjunction with the accompanying drawing.

SUMMARY OF THE INVENTION

In carrying out this invention, I provide a roll of gummed tape which is marked with spaced pairs of parallel, transverse marks along its length. The space between each pair of marks is equal to the length of the printed page and the space between marks of each pair is equal to the space between successive printed pages. A length of the tape is threaded through the rollers following the printing unit through to the mark on the former section of the printing press. There, the marks are aligned approximately with an orientation mark or marks. Such marks could be painted or otherwise applied to some part of the former section or, in some instances, where a previous run is still in the press, the tape marks could be aligned with the actual margins of the previously printed sheet. Then, tapes are fed through first and second impressions of the printing unit to be adhered together. The trailing end of the first tape is then dropped down to the printing unit and marks thereon aligned with the blanket opening of the second impression. After adhering this tape to that coming from the second impression, marks at the forward end are aligned with the orientation mark at the former by taking out slack and adjusting rollers. The trailing end of the tape fed into the printing section is then dropped into the archway or lower compartment to be attached to the next roll of newsprint. The tape is adhered to the leading end of that roll to pull the web through the printing press.

DESCRIPTION OF A PREFERRED EMBODIMENT

Figures 1, 2:
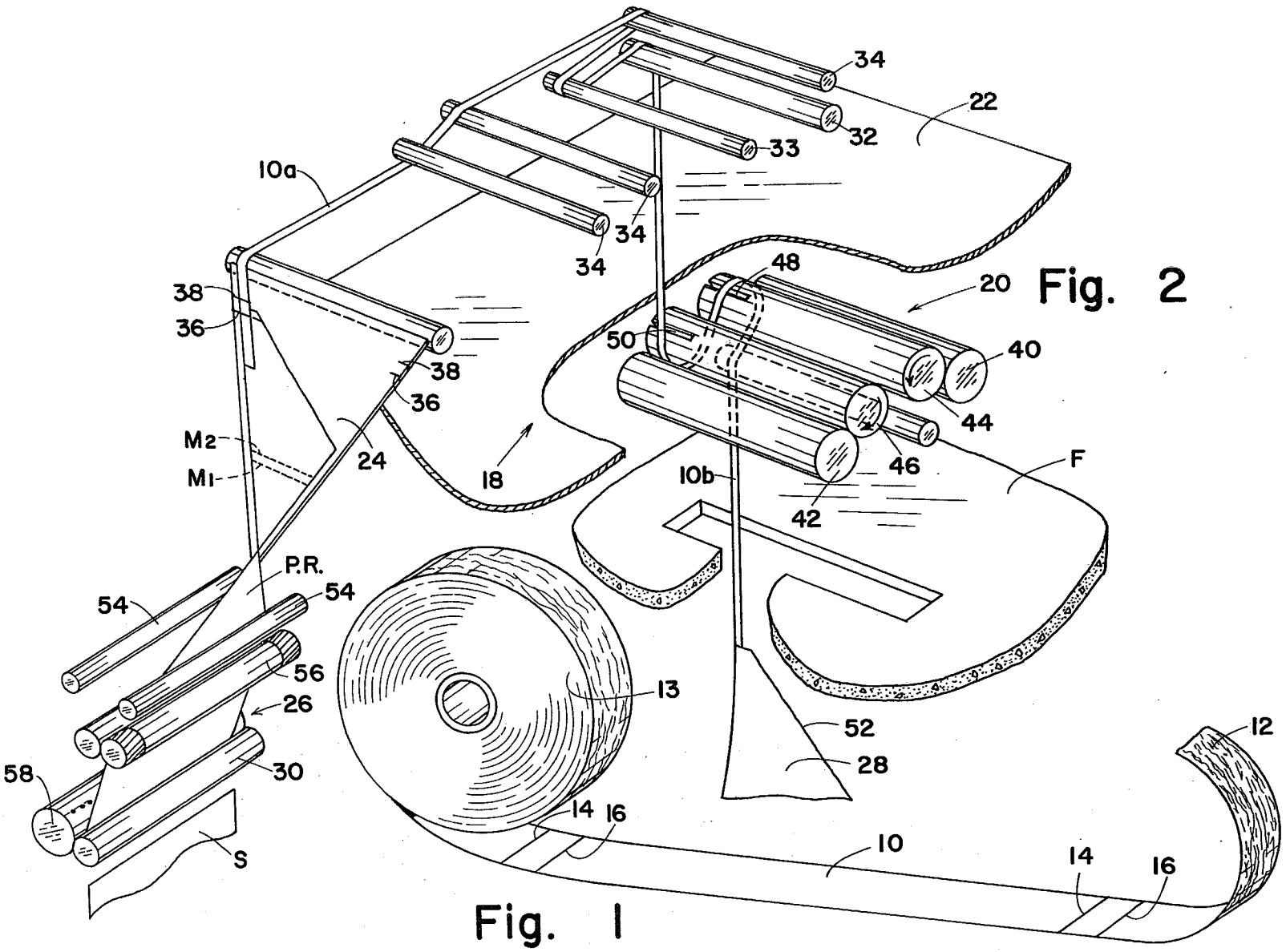
FIG. 1 is a view in perspective of the orienting tape.
FIG. 2 is a more or less a schematic view in perspective of a printing press including the web orienting device of this invention.

Referring now to the drawing with greater particularity, there is shown at FIG. 1 tape 10 of paper, fabric or the like having a suitable adhesive 12 on the back side thereof and, preferably, carried on a roll 13. Printed on the top of the tape along the full length thereof is a series of parallel, transverse marks 14 and 16. The space between marks 14 and 16 of each pair is equal to the length of the margin between succeeding printed pages of a newspaper, and the space between pairs of marks 16 and 14 represents the length of the printed matter on each printed page. Hence, if properly aligned in the printing press, the tape can be attached to a roll of newsprint and oriented properly with respect to the press.

A typical printing press 18 (FIG. 2) has a printing unit 20, a platform or boards shown schematically at 22, a former 24 and a folder section 26. When a new web of newsprint 28 is fed through the press, it must be so oriented that the cutting cylinder 30 at the folder section 26 severs the sheet within the margin between successive printed pages and, preferably, precisely in the center of that margin. According to the present practice, this requires considerable jockeying and manuevering of the wide, relatively delicate newsprint.

In the method of this invention, a roll 13 of the orienting tape 10*a* is retained on the boards 22 near the printing section 20 and the leading end of that roll is threaded through the drag roller 32, compensating roller 33 and a series of idler rollers 34 to the former 24. There, a pair of alignment marks 14 and 16 on the tape length 10*a* is aligned with orientation marks at the former which indicates the precise position at which the corresponding margin of a newsprint must be situated in order to be properly severed by the knife at the cutting cylinder 30. Where the trailing end of the web P.R. or a previous run remains at the former, the orientation marks used could be the corresponding margins M1 and M2 of the actual printed page. Preferably, however, these positions can be determined by properly locating a web with exactitude, in accordance with the present practice, and then painting marks 36 and 38, or a single painted stripe with aligning edges 36 and 38, on the former for permanent orientation purposes.

At this juncture alignment at the former 24 need not be made with precision and attention is directed back to the printing section. Lengths of tape are stuffed into the blanket openings of the first and second impressions 44 and 46, fed through those impressions, and adhered together. Then, the roll carrying the first tape 10*a* is dropped from the boards; a pair of marks 14 and 16 are aligned with the blanket opening 50 on the second impression 42; and the tape 10*a* is adhered to the tape at the printing section. Then the trailing portion of tape 10*b* is dropped to the reel room below the floor level F where the next web of newsprint is being prepared.

In the meantime, the first tape 10*a*, so aligned with the blanket opening 50 is pulled taut, and by adjusting the compensating roller 33 or making other adjustments as necessary, the forward pair of marks 14 and 16 are aligned precisely with the mark 36, 38. With the orientation complete, the tape 10 is adhered to the next newsprint web 28 at the leading end thereof, which is torn at 52 at an angle to facilitate feeding. The press is then started up and the tape 10*a*, 10*b* pulls the web 28 through the press 18 (FIG. 2) with the printing section and the folder section 26 in proper synchronization.

When the web 28 passes the alignment marks 36 and 38 on the former it passes through guide rollers 54 and nipping rollers 56 and is pressed against the cutting cylinder by the cutting rubbers in the following cylinders 58 where the web is severed into sheets S. With the alignment having been made by the easy-to-handle tape, the cut is made precisely at the center of the margin, saving costs of labor time and make-ready waste.

While this invention has been described in conjunction with a preferred embodiment thereof, it is obvious that modifications and changes therein may be made to those skilled in the art without departing from the spirit and scope of this invention, as defined by the claims appended hereto.

What is claimed as invention is:

1. A method of orienting a newsprint web to be fed through a press comprising;

providing an extensive length of adhesive tape;

providing a plurality of pairs of marks on the upper side of said tape along the length thereof;

each of said pairs of marks being spaced to be aligned with, respectively, the top of a first printed page and the bottom of the next succeeding printed page;

establishing a first aligning point on the former of said press with which one of said margins of a printed sheet must be aligned in order to be severed properly;

aligning the appropriate mark of one of said pairs thereof with said first aligning mark;

aligning a subsequent pair of marks with second aligning points in the printing unit at which the appropriate margins of a printing sheet are impressed; and attaching the trailing end of said tape to said newsprint web to be run through the press.

2. The method of orienting defined by claim 1 wherein:

said first aligning point is a mark made on the former and cutter assembly along the path to be traversed by a printed web.

3. The method of orienting defined by claim 1 wherein:

said first aligning point is a margin of a printed sheet impressed on a previous length of newsprint.

4. The method defined by claim 1 wherein:

at least two lengths of tape are employed;

a first length of tape is run through the section of the newspaper printing press following the printing unit and the appropriate mark of a pair thereof is aligned with said first aligning point;

additional tape is run through the impression cylinder; and the trailing end of said first length of tape is brought to the printing unit;

a second pair of marks thereon is aligned with said second aligning points and said trailing portion of said first length is adhered to the leading end of said additional tape; and the trailing end of said additional tape is dropped to adhere a roll of newsprint web to be fed through the press.

5. A device for orienting a newsprint web to be fed through a press comprising:

an elongated tape having adhesive on one side thereof;

a plurality of pairs of marks on the other side of said tape along the length thereof;

the space between each of said pairs of marks being equal to the length of the print on a standard printed newspaper page; and the space between marks of each pair thereof being equal to the space between the top of the print on a first printed newspaper page and the bottom of the print on the next succeeding printed page on a web.

* * * * *